US007214336B2

(12) United States Patent
Sheridan et al.

(10) Patent No.: US 7,214,336 B2
(45) Date of Patent: May 8, 2007

(54) FINGER WEDGE FOAM

(75) Inventors: Phil Sheridan, Saginaw, MI (US); John I Nanos, Saginaw, MI (US); Lendell J Williams, St. Charles, MI (US)

(73) Assignee: Lendell Manufacturing, Inc., St. Charles, MI (US)

( * ) Notice: Subject to any disclaimer, the term of this patent is extended or adjusted under 35 U.S.C. 154(b) by 350 days.

(21) Appl. No.: 10/344,458

(22) PCT Filed: Aug. 14, 2001

(86) PCT No.: PCT/US01/25562

§ 371 (c)(1),
(2), (4) Date: Feb. 11, 2003

(87) PCT Pub. No.: WO02/13655

PCT Pub. Date: Feb. 21, 2002

(65) Prior Publication Data

US 2004/0089320 A1 May 13, 2004

Related U.S. Application Data

(60) Provisional application No. 60/225,223, filed on Aug. 14, 2000.

(51) Int. Cl.
*B28B 5/00* (2006.01)
*B28B 1/48* (2006.01)

(52) U.S. Cl. ..... 264/250; 264/154

(58) Field of Classification Search ..... 132/320, 132/321, 317, 319; 401/7; 2/21, 160, 163; 264/154, 250

See application file for complete search history.

(56) References Cited

U.S. PATENT DOCUMENTS

| | | | | | |
|---|---|---|---|---|---|
| 1,297,784 | A * | 3/1919 | Birnbaum | 15/227 |
| 2,002,144 | A * | 5/1935 | Heaton | 132/320 |
| 2,360,457 | A * | 10/1944 | Wells | 132/74.5 |
| 2,511,557 | A * | 6/1950 | Arnold | 15/227 |
| 2,621,784 | A * | 12/1952 | Van Boytham | 206/361 |
| 3,226,754 | A * | 1/1966 | Brittain | 15/230.11 |
| 3,903,345 | A * | 9/1975 | Baker et al. | 442/395 |
| 4,213,472 | A * | 7/1980 | Gueret et al. | 132/320 |
| 4,446,965 | A | 5/1984 | Montiel | 206/205 |
| 4,998,838 | A | 3/1991 | Cancelosa et al. | 401/202 |
| 5,853,012 | A * | 12/1998 | Burns et al. | 132/320 |
| 5,983,902 | A * | 11/1999 | Heneghan et al. | 132/200 |
| 6,167,890 | B1 | 1/2001 | Gueret | 132/200 |
| 6,245,263 | B1 * | 6/2001 | Yoshizaki et al. | 264/45.5 |
| 6,325,565 | B1 * | 12/2001 | Girardot et al. | 401/266 |

* cited by examiner

*Primary Examiner*—John J. Wilson
*Assistant Examiner*—Robyn Doan
(74) *Attorney, Agent, or Firm*—Warn Hoffmann Miller & LaLone PC

(57) ABSTRACT

A flexible foam wedge, designed with a finger pocket and application tip with that allows for direct support of the applicator from a finger digit particularly useful for the application of cosmetics. The foam applicator comprises a base block defining the finger opening. The application tip, having any of a plurality of configurations extends from the base block. The applicator can be an integral unit, or can comprise separate components connected together. Further, various methods of manufacturing and using the applicator are provided.

27 Claims, 13 Drawing Sheets

FINGER WEDGE FOAM

This application is based on and claims priority in U.S. Provisional Patent Application Ser. No. 60/225,223 filed 14 Aug. 2000.

BACKGROUND OF THE INVENTION

1. Field of the Invention

The present invention relates to foam applicators for use on a finger or other digit. The foam applicators are particularly useful for the application of cosmetics.

2. Description of the Related Art

In the past, cosmetic applicators have taken a variety of shapes such as pads, rounds, puffs, swabs, etc. as a means for applying various cosmetic products. Direct hand application of cosmetic products is undesirable, since the fingers do not optimally retain or apply the cosmetic product. The use of swabs is common as it provides an extension for an applicator, although by nature it is a less direct method of cosmetic product application. Such a swab applicator is shown in WO 99/58017. Furthermore, applicators of the past have often been complicated or uneconomical for efficient use.

SUMMARY OF THE INVENTION

According to the present invention, there is provided an applicator comprising a base block. The base block defines a bottom surface. At least one side wall extends from the bottom surface. The applicator further comprises a foam application tip extending from the base block. The applicator further includes a finger opening extending from the bottom surface between the side wall. The finger opening is sized to receive at least a portion of a user's finger.

Also provided are methods for forming the applicator. One such presently preferred method comprises forming a first sheet of foam material to define a blank. At least one applicator is formed from the blank such that each applicator defines a base block and an application tip extending from the base block. A finger opening is formed in the base block.

Another such presently preferred method comprises providing a mold defining a cavity therein. Foam is injected into the cavity and allowed to cure to define a blank. The blank is then removed from the mold. The shape of at least one applicator comprising a base block and an application tip is cut in the blank. At least one opening is cut through said base block. Finally, a finger opening is cut in the base block transverse to the opening.

An alternate presently preferred method for forming the applicator comprises providing a mold defining a cavity therein. A plurality of finger pins are provided in the cavity. Foam material is injected into the cavity and about the finger pins and allowed to react to define a blank having a plurality of finger openings. The finger pins are removed from the cavity, and the blank is removed from the mold. The shape of at least one applicator comprising a base block and an application tip is cut in the blank about the finger openings.

Yet another presently preferred method of forming the applicator comprises forming a first sheet. A plurality of finger openings are formed in the first sheet. A second foam sheet having a plurality of application tips formed or cut thereon is obtained. The first sheet is adhered to the second foam sheet. The applicators are cut from the combined first sheet and second foam sheet such that each applicator defines a base block with the finger opening and an application tip extending from the base block.

Yet another presently preferred method of forming the applicators comprises forming a blank of foam material. A plurality of through holes are formed into the foam block. Further, the foam block is cut to provide the shape of individual applicators. Subsequently, finger openings are cut through the foam and connected to the through holes.

A method for using the applicator is also provided. The presently preferred method comprises obtaining an applicator having a base block with a finger opening and a foam application tip. The base block is placed on a user's finger. The application tip is placed in a material to be applied, and the material is applied to a surface.

BRIEF DESCRIPTION OF THE DRAWINGS

Presently preferred embodiments of the invention are disclosed in the following detailed description and in the accompanying drawings wherein.

DETAILED DESCRIPTION OF THE PREFERRED EMBODIMENTS

An applicator is generally shown at 10 in the figures. The applicator includes a base block generally indicated at 12. In one preferred embodiment, the base block 12 comprises a bottom surface 14 and four side walls 16 extending upwardly from the bottom surface 14. A finger opening 18 is also included. The finger opening 18 extends upwardly from the bottom surface 14 interiorly of the side walls 16. The finger opening 18 is sized to receive at least a portion of the user's finger. It will be appreciated that while the preferred embodiment is for use on a user's finger, that in certain instances, the device may be used on other digits, such as, for example, a user's toes.

Figure 6A:
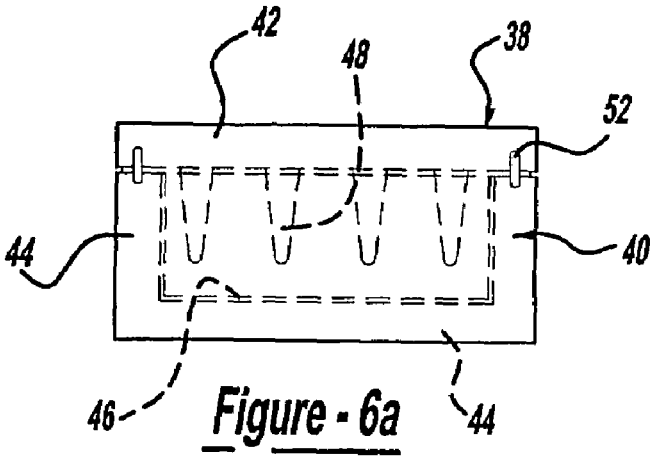
FIG. 6*a* shows a side view of a mold for molding a blank.
Figure 6B:
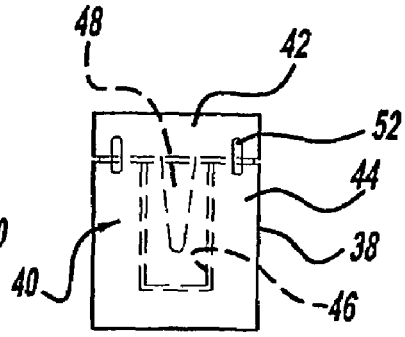
FIG. 6*b* is an end view of a mold for molding a blank.
Figure 6C:
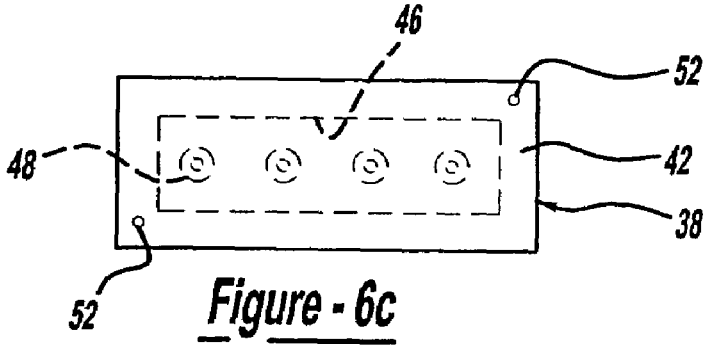
FIG. 6*c* is a top view of a mold for molding a blank.
Figure 6D:
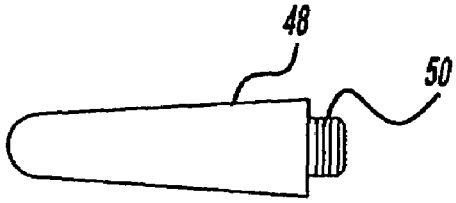
FIG. 6*d* is a plan view of a mold insert for molding the finger cavity.
Figure 6E:
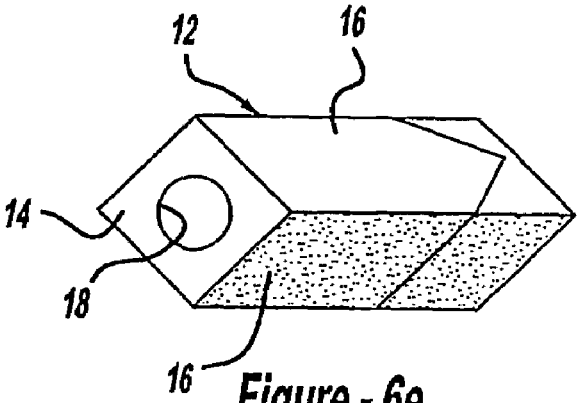
FIG. 6*e* is a perspective view of a finger wedge having been removed from the block and showing the cut lines.
Figure 7A:
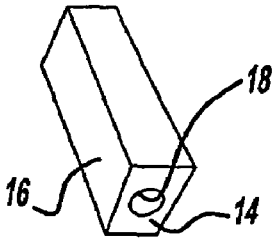
FIG. 7*a* shows a foam block having a finger opening.
Figure 7B:
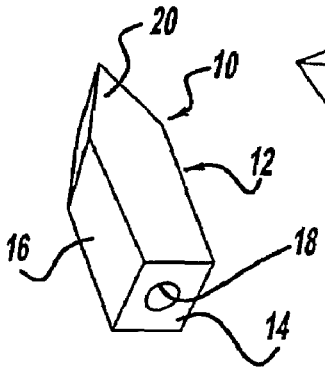
FIG. 7*b* shows a perspective view of one preferred applicator.

In one preferred embodiment as best seen in FIGS. 6*e* and 7*b*, the base block 12 has a generally square or rectangular cross-section. It will be appreciated, however, that any number of side walls including a single side wall having a circular cross-section as shown, for example, in FIG. 3, may be used. The area between the side wall 16 is filled and that area as well as the side walls themselves preferably comprise foam.

The base material for the cellular foam is a polymeric material such as a foamed organic plastic. The air pockets, which comprise of the cells, can be open or closed. Exemplary of acceptable polymers employed in the foaming industry are polyurethane, ethylene/vinyl acetate (EVA) copolymer, latex, polyethylene, polypropylene, butyl, silicone, cellulose acetate, neoprene, epoxy, polystyrene, phenolic, polyvinyl chloride (PVC), and other related polymers.

In designing the base for the cellular foam, the base polymer, prepolymer (liquid or solution), or reactants and fabrication are accomplished according to conventional or non-conventional foaming techniques. During fabrication, selecting a liquid polymer and/or elastomer/reactant, and then causing the foregoing to be foamed forms the cellular foam. Common methods of foaming include adding a hardening agent, which causes a chemical reaction, thermally setting the base material with heat, or bubbling a gas through the liquid polymer/elastomer while hardening, or other methods well known to those skilled in the art.

The applicator 10 further includes a foam application tip 20. The foam application tip 20 extends from the base block 12. The foam used for the application tip 20 is the same as that set forth above.

Some basic design styles are shown in FIGS. 1*a*–1*f*. These shapes represent some possible shape combinations of the finger openings 18 with various application tip 20 shapes. It will be appreciated that the application tip 20 is preferably contoured and can take any configuration depending upon the final use of the applicator 10. The finger opening 18 within the interior of the base block 12 allows finger insertion thus defining a finger cot or pocket. This finger opening 18 allows for a relatively more controlled application of material to be applied due to the fact the foam application tip 20 is controlled directly by a user's finger inserted into the opening 18. The various shaped tips 20 allow for different uses. For example, rounded shapes allow for large area spreading, while the pointed tips can be used for point specific blotting, applying, etc.

It will be appreciated that the applicator 10 is particularly useful as a cosmetic applicator. The applicator 10 allows for the physical application by a generally wedge shaped foam object, directly mounted to a finger or other digit. While the applicator 10 is particularly useful for applying cosmetics, the intended use of the applicator 10 can be any imaginable use. Some other uses for the presently preferred applicator are in connection with application of paints, sunscreens, lotions, baby products, etc. Further, the applicator can be used as a cleaning aid used to wipe various components. Other applications may include use as a chalkboard or dry board eraser when minor changes are required to be made in something written on a chalkboard or dry board.

Figure 1A:
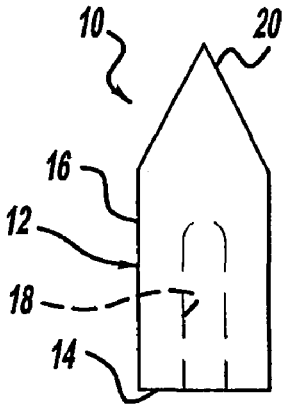
FIGS. 1*a*–1*f* are elevational views showing some sample shapes for the application tip and finger opening.
Figure 1B:
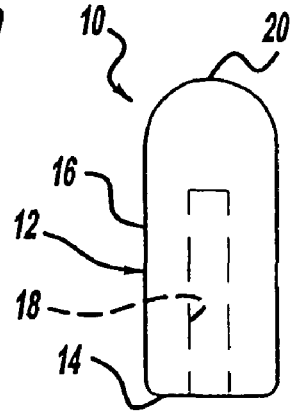
Figure 1C:
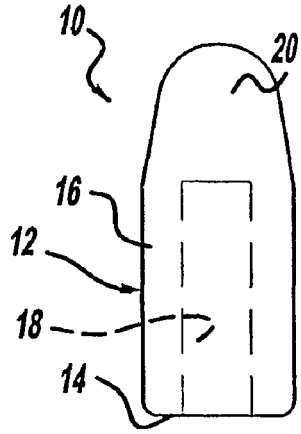
Figure 1D:
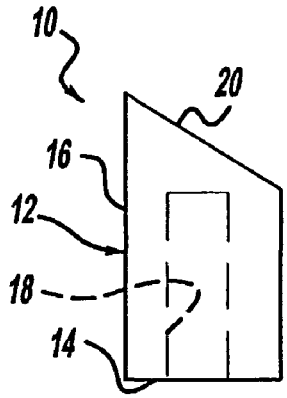
Figure 1E:
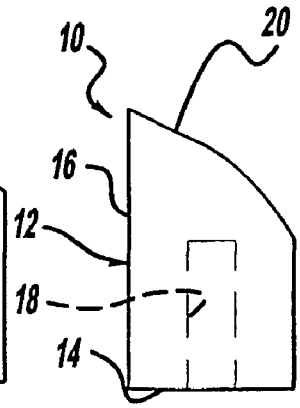
Figure 1F:
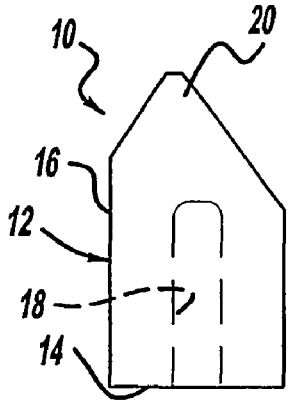
Figure 2:
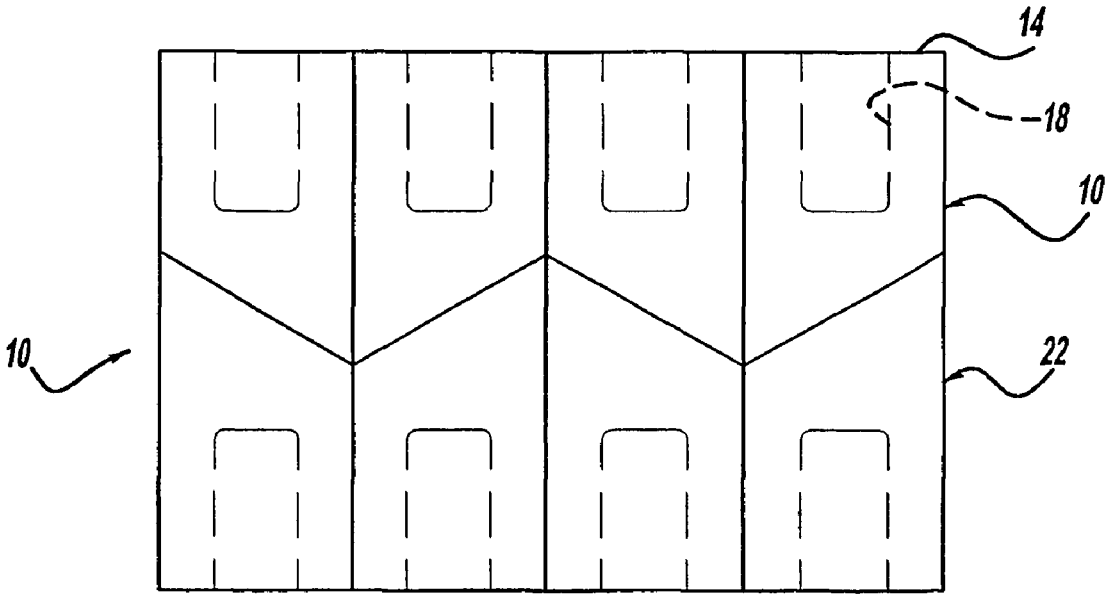
FIG. 2 is a top plan view showing a sample block design to make the various applicators.

It is preferred that several applicators 10 are formed together from a large sheet or a blank and cut to the specific configuration desired. FIG. 2 shows an example of a formed sheet or blank generally indicated at 22 used to make several applicators 10. The blank 22 design of FIG. 2 allows for the efficient, simultaneous production of several applicators 10, especially as a variety of shapes for the tip 20 can be cut such as by die cutting from a single blank 22, eliminating or reducing waste inherent with unusual shapes.

It will be appreciated that the blank 22 can be formed in any manner. For example, the blank 22 can be formed by casting the foam into open blocks or into continuous sheets or rolls. Alternatively, the blank 22 can be made by reaction injection molding the blank 22. These methods are well known in the art. If large sheets are formed, they will constitute the blank 22 and may either be cut first into smaller foam blanks from which the individual applicators may be formed, or alternatively, the cutting operation of the blank 22 may simultaneously form a plurality of applicators 10. In this case, a large sheet or even rolled sheet comprises the blank 22, may be fed into a die cutter, which cuts the individual applicators 10, preferably in a continuous manner.

When the applicators 10 are made from a blank 22, the base block 12 and foam application tip 20 are formed as a single piece. That is, once the applicator is formed, such as by die cutting from the blank 22, it is a single, unitary foam material including both the base block 12 and foam application tip 20. Further, the finger openings 18 may be simultaneously molded onto the blank 22. Alternatively, the finger openings 18 may be cut, or otherwise formed into the base blank 22 or directly into individual applicators 10.

Figure 3:
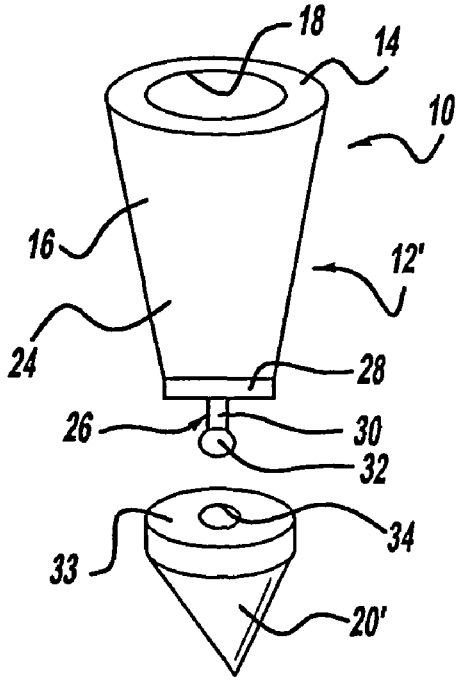
FIG. 3 is a perspective view of an alternate embodiment of an applicator.

FIG. 3 shows an alternate preferred embodiment having a two-part design that allows for replaceable tips 20. The assembly includes a base block 12' that defines a singular side wall 16 extending from a bottom surface 14. Specifically, a sock or sleeve 24 of elastic, foam or other suitable material is provided. The sleeve 24 includes the finger opening 18 forming a pocket for a finger. A connector, generally indicated at 26, is also provided. The connector 26 shown preferably comprises a mounting base 28 connected with the base block 12'. A post 30 extends from the mounting base 28 in a direction away from the sleeve 24. The post 30 has a ball tip 32 thereon.

A separate foam tip 20' is adapted for connection with the connector 26. As shown, the foam tip 20' includes an engaging surface 33 and a receiving opening 34 extended from the engaging surface 33 for receiving the post 30. To connect the foam tip 20' with the base block 12, the foam tip 20' is placed over the connector 26. The base block 22 and foam tip 20' are pushed closer until the post 30 is disposed within the receiving opening 34. Preferably, the diameter of the ball tip 32 is slightly larger than the diameter of the receiving opening 34. In this manner, the ball tip 32 will engage the receiving opening 34 and retain the foam tip 20' on the connector 26.

While the connector 26 is preferably shown to comprise a mounting base 28 having a post 30 thereon, the connector 26 could also be a flat surface for receiving Velcro, adhesive, tape, snaps or the like. Any suitable connector 26 may be used. Similarly, the foam tip 20' may include Velcro, adhesive, tape, snaps or the like to connect it with the connector 26 on the sock 24. Again, any method of securing the tip 20' with the sleeve 24 is contemplated. Preferably, a detachable method is used so the sleeve 24 can be used with several tips 20'. This method offers the ability to connect a wide variety of tip 20' designs to a single base block 12.

Figure 4:
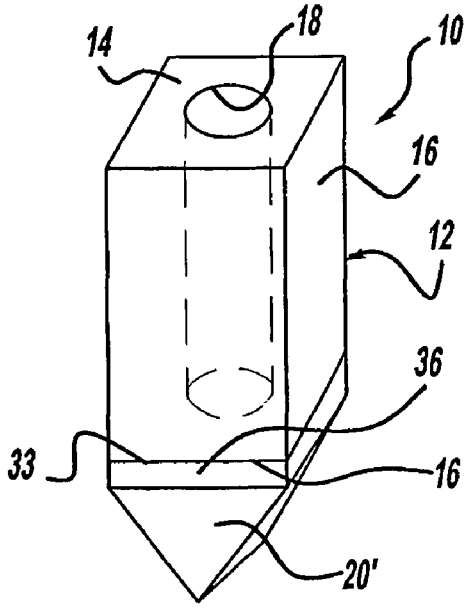
FIG. 4 is a perspective view of an alternate embodiment of an applicator.

In another preferred embodiment as shown in FIG. 4, an alternate two-part design as described above is used. The base block 12 has four side walls 16 extending from a bottom surface 14. Also provided is a top surface 36. Thus, the base block 12 comprises a block having a generally square or rectangular cross-section. A finger opening 18 extends inwardly of the side wall 16 from the bottom surface 14.

An application tip 20' is also included. The application tip 20' comprises a foam, as set forth above and has an engaging surface 33. The application tip 20' may be secured to the top surface 36 of a block 12 utilizing any method, such as, for example, the use of Velcro, adhesive, tape, snaps, or the like.

The use of the design of FIG. 4 also allows for the use of a base block 12 having a color different from the color of the application tip 20'. By the use of a different color tip 20' from the base block 12, a user can more readily distinguish the replaceable tip 20' section from the base block 12.

Figure 5A:
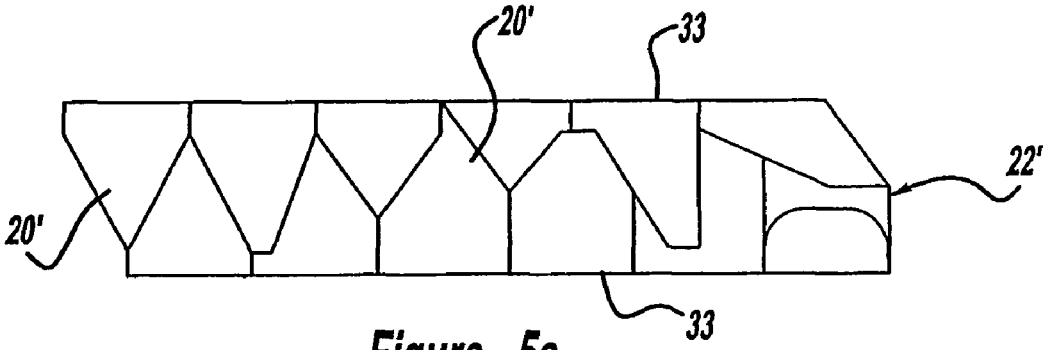
FIGS. 5*a*–5*b* is a top plan view of a block design showing various alternative tip configurations.
Figure 5B:
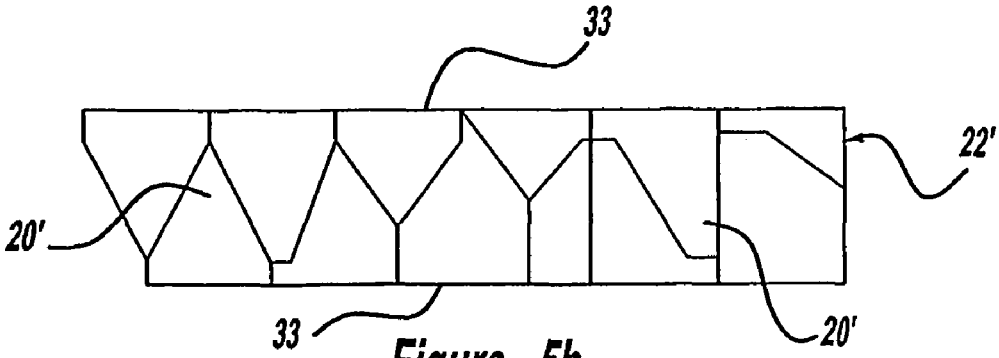

FIG. 5 shows another blank 22' depicting some possible tip 20' varieties that can be used according to the type of application desired. These tips 20' are shown within the construction of a master blank 22', to illustrate the efficiency of cutting various patterns for minimal base foam waste. While not specifically shown, a receiving opening can be cut in the tip 20' to engage a receiving post 30 as described above. Again, the blank 22' may be produced in any manner.

FIGS. 6*a*–6*c* show a mold construction in accordance with one presently preferred method. As shown, the side view of FIG. 6*a* includes a mold generally indicated at 38. The mold 38 includes a bottom surround generally indicated at 40. The mold 38 also includes a top 42. Preferably, the top 42 and bottom surround 40 of the mold 38 are made of metal. When the top 42 is placed on the bottom 40, a mold cavity 46 is defined between the walls 44 of the bottom surround 40 and the top 42. The cavity 46 can comprise any configuration to make either individual applicators 10 or a blank 22 from which multiple applicators can be made. As shown, the mold 38 will make a blank 22 having a plurality of finger openings 18 molded therein.

A plurality of tapered finger pins 48 extend downwardly from a top 42 of the mold 38. The finger pins 48 are preferably covered with a non-stick surface, such as, for example, with Teflon tape, and extend into the mold cavity 46. As best shown in FIG. 6*b*, the finger pin 48 may include a threaded connection portion 50 for attaching the finger pin 48 to the top 42. More specifically, the top 42 may include threaded openings for receiving the threaded connector portion 50 of the pin 48. In this manner, the pins 48 can be releasably secured into the top 42. It will be appreciated, however, that the finger pins 48 may be permanently secured to the mold 38 in any suitable manner.

Alignment pins 52 are used to align the top 42 with the bottom surround 40 of the mold 38. The alignment pins 52 can be located at any location between the top 42 and bottom surround 40. Further, the pins can be used merely to align and locate the top 42 on the bottom surround 40. In such a case, a suitable clamp, not shown in FIGS. 6*a*–6*c*, may be used to secure the top 42 to the bottom surround 40 during the molding operation. Alternatively, the pins 52 may be configured to secure the top 42 with the bottom surround. For example, the pins 52 may be threaded and extend all the way through the top 42 and into a threaded opening in the walls 44 of the bottom surround 40. It will be appreciated that at least one of the top 42 and bottom surround 40 of the mold 38 also includes a port for allowing the foam material to be injected into the mold cavity 46.

Figure 6F:
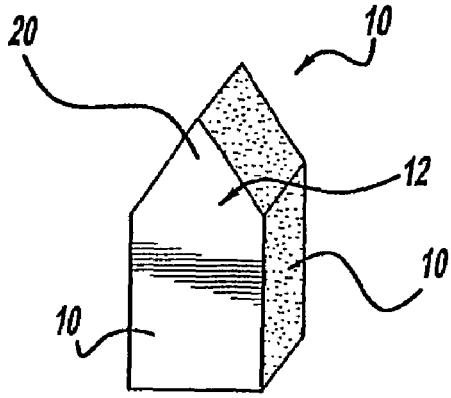
FIG. 6*f* is a perspective view of an applicator in accordance with one preferred embodiment of the present invention.

When a mold of the type shown in FIGS. 6*a*–6*c* is used, a master foam blank 22 containing a plurality, four as shown, of individual applicators is produced. The master blank 22 is a block having a generally rectangular cross-section with four finger openings 18 integrally molded therein. The master blank 22 formed is then cut into the individual applicators such as shown in FIGS. 6*e*–6*f*. As shown in FIG. 6*e*, a square finger wedge is formed which finger wedge is cut from the foam block 22 produced in the mold cavity 58. The square finger wedge includes the side walls 16, bottom surface 14 and finger openings 18. The tip 20 is not yet cut. FIG. 6*e* shows the line along which the application tip 20 may be cut. Finally, the finger wedge is cut to produce a tip 20 having its desired final shape also shown in FIG. 6*f*. It will be appreciated that the tip 20 may take any configuration.

Figure 7C:
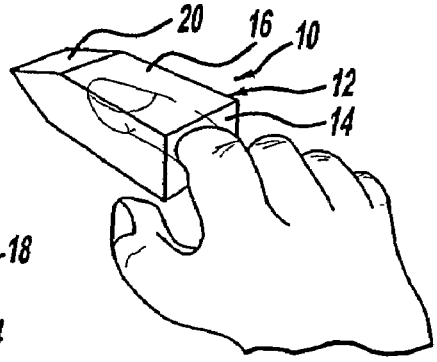
FIG. 7*c* is a perspective view of an applicator on a user's finger.
Figure 7D:
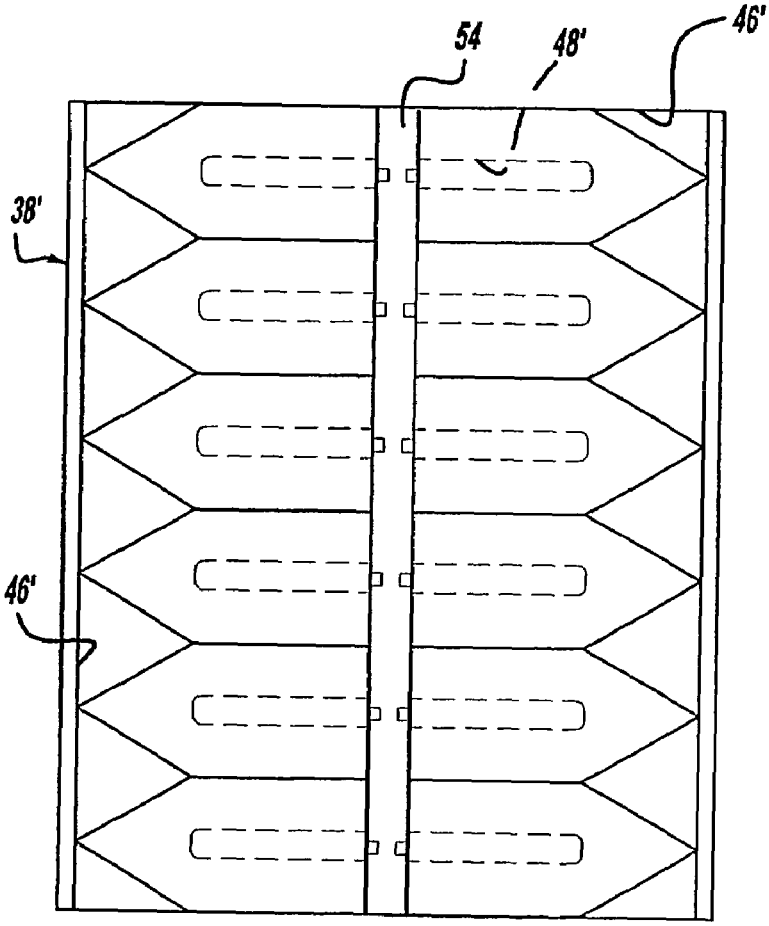
FIG. 7*d* is a top plan view of a mold for making a foam blank, and showing sample cut lines for making a plurality of applicators.

FIG. 7*d* shows an alternate mold cavity 46' arrangement. The mold 38' includes a central branch 54. The finger pins 48' are shown extending from a central branch 54. By utilizing a mold 38' in this manner, two mold cavity segments 46' are produced. Each mold cavity segment 46' produces a master foam blank 22 (FIG. 7*e*), which can be cut into several applicators, FIGS. 7*a*–7*b*. As shown, applicators with pointed tips 20 are produced.

Figure 7E:
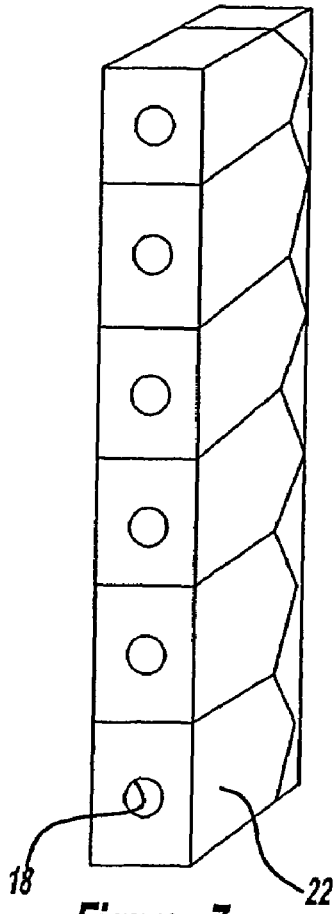
FIG. 7*e* is a perspective view of a foam blank and showing the lines for cutting the respective applicators.

FIG. 7*d* further shows the lines where the applicators may be cut. Similarly, FIG. 7*e* depicting the master blank 22 having the finger openings 18 molded therein also shows the lines along which the individual applicators may be cut. FIG. 7*a* shows the finger wedge formed after the first cut is made separating the individual applicators. FIG. 7*b* shows the final applicator 10 after the tip 20 having the desired configuration has been cut into the finger wedge shown in FIG. 7*a*. It will be appreciated that the cutting of the foam wedge and application tip 20 may be done simultaneously.

FIG. 7*c* shows the applicator 10 with the user's finger inserted into the finger opening 18. It will be appreciated that the finger opening 18 will take a configuration suitable to accept the user's finger. Because the finger opening 18 is surrounded either by a foam or an elastic material, it readily adapts to the shape of the user's finger.

Again, it will be appreciated that the finger openings may be molded into the blank 22. Alternatively, the finger pins 48' may be excluded from the mold and in such a case, the finger openings will be formed in the applicator in accordance with any acceptable method.

Figure 8:
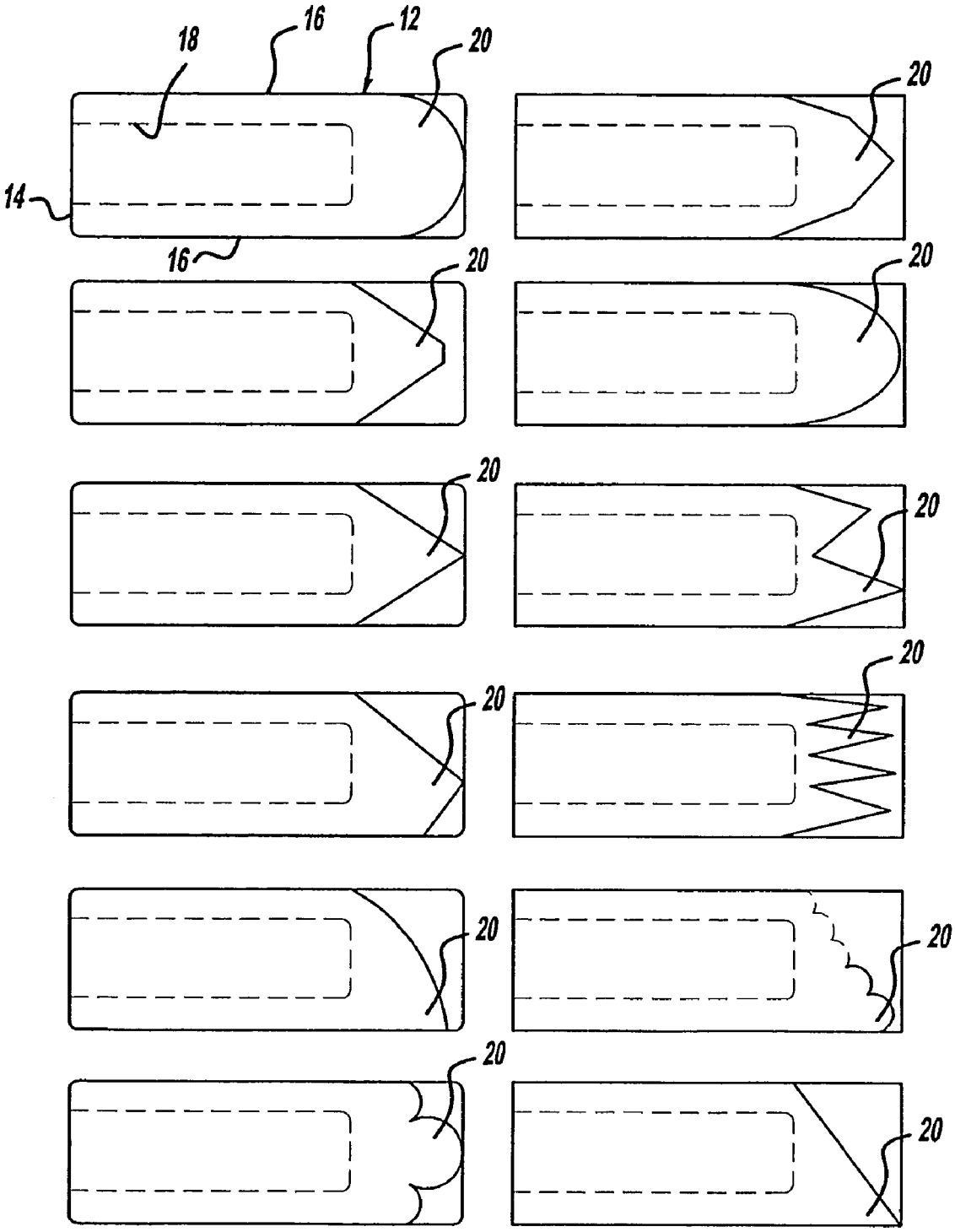
FIG. 8 shows multiple plan views of various applicators that can be formed from a blank.

FIG. 8 shows several individual wedges with some potential shapes for the various application tips 20 that may be used. Specifically, FIG. 8 depicts the lines along which the individual application tips 20 may be cut to form an applicator. The configuration of each of the applicators depicted is identical except for the configuration of the tip 20. Obviously, it is understood that the application tips 20 can take any configuration and are not limited to those shown in FIG. 8.

Figure 9:
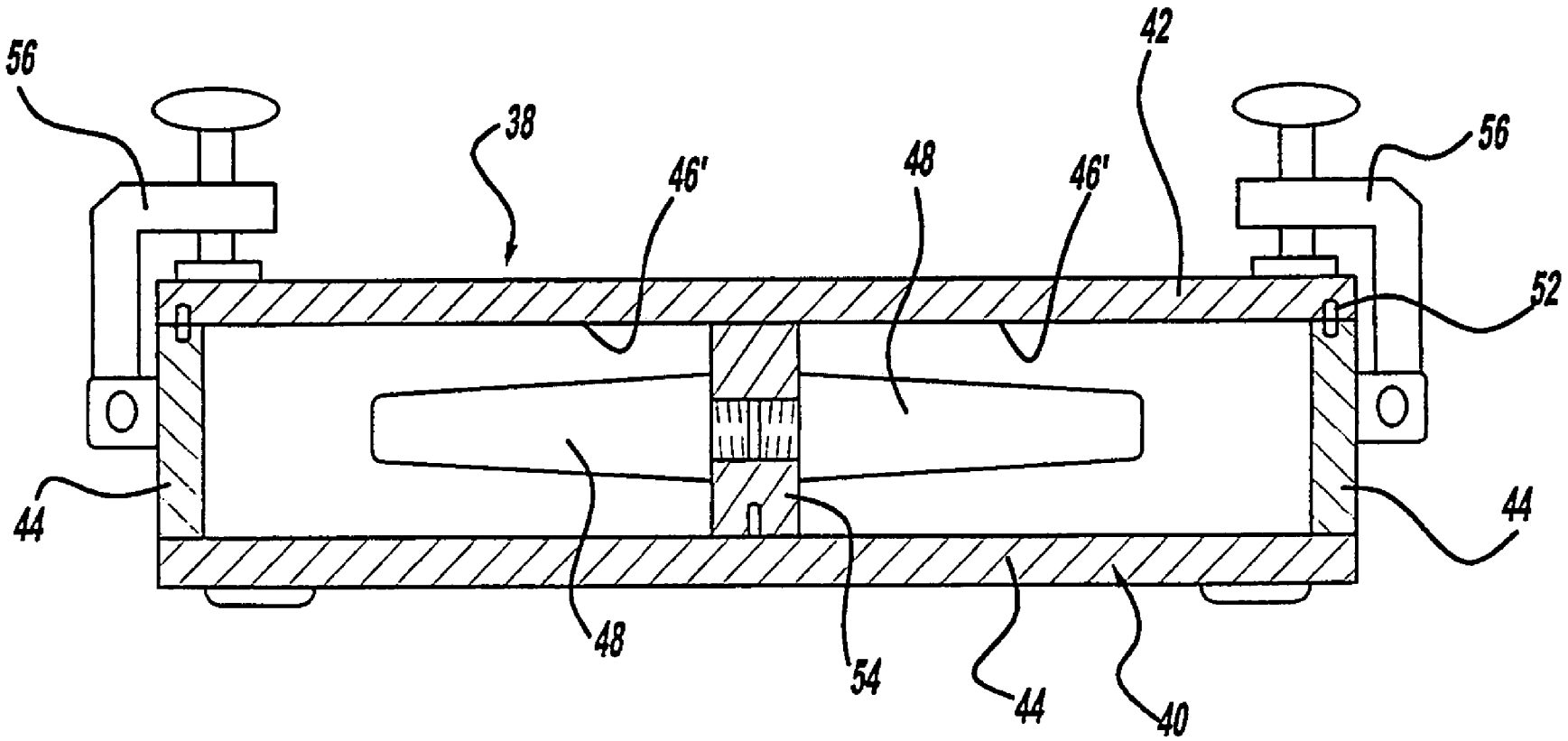
FIG. 9 shows one presently preferred mold for making applicators.
Figure 10A:
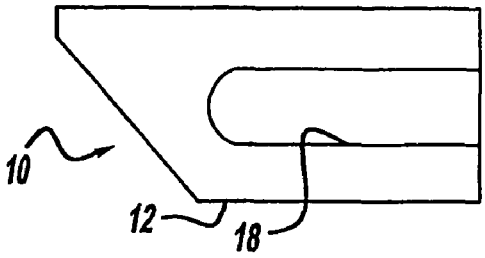
FIGS. 10*a*–10*g* represent an alternate method of forming an applicator.
Figure 10B:
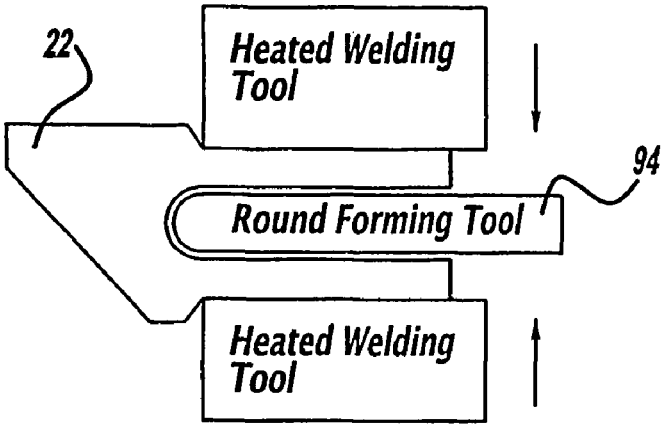
Figure 10C:
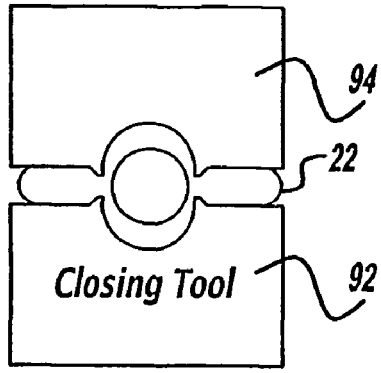
Figure 10D:
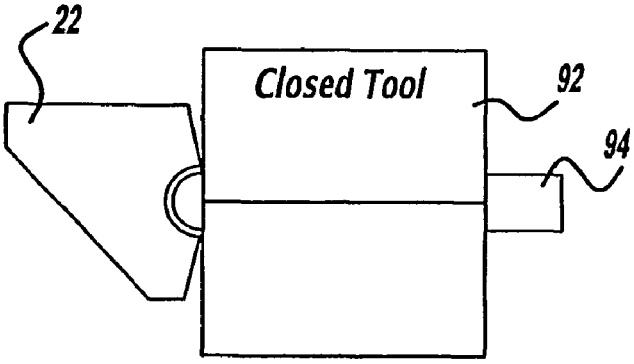
Figure 10E:
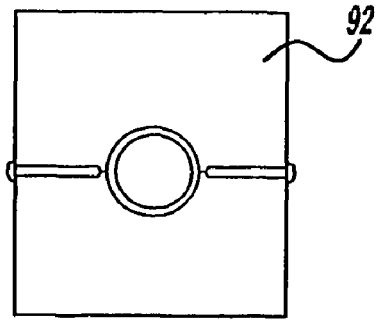
Figure 10F:
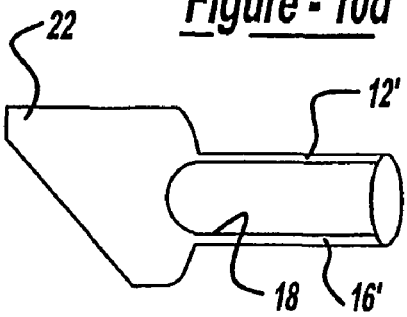
Figure 10G:
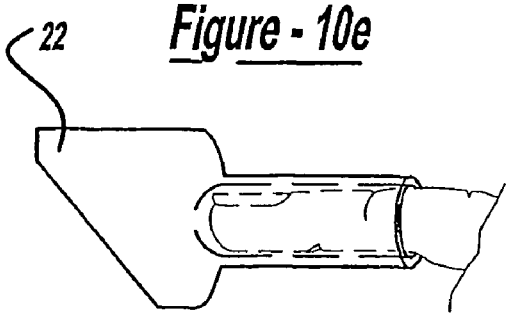

FIG. 9 shows a cross-sectional view of the mold of FIG. 7*d*. Again, two mold cavity segments 46' are produced when utilizing a design of this nature. The finger pins 48 are threaded into the main branch 55. A top 42 is secured to the bottom 40 having a plurality of walls 44 of the mold 36 and is aligned by a plurality of locator or alignment pills 52. Clamps 56 are used to secure the top 42 to the bottom 40. Once the top 42 is secured to the bottom 40, foam is injected through a suitable port into the cavity segments 46' and the foaming reaction takes place. Upon completion of the foaming operation, the top 42 is removed and the formed foam blanks 22 are removed from each mold cavity segment 46'. The foam blanks 22 can then be formed into any desired configuration.

FIG. 10 shows a schematic for an alternate preferred method for making an applicator 10. Originally, an applicator 10 having a finger opening 18 is formed in accordance with any method. The base block 12 is then thermoformed by application of heat and pressure. The thermoforming process takes place by heated pressing of a foam shape around a forming tool. The thermoforming process results in a solid, stretchy, rubber-like material in the areas thermoformed. As shown in FIG. 10*b*, a heated welding tool 92 is used. Also, a round forming tool 94 is inserted into the finger opening 18. Once the round forming tool 94 is inserted in the finger opening 18, the heated welding tool 92 is closed, applying pressure to the base block 12, FIGS. 10*c*–10*e*. Upon completion of the thermoforming process, the base block 12' is shown to include a singular side wall 16' that is a solid, stretchy, rubber-like material that can be stretched over a user's finger, FIG. 10*g*. The finger opening 18 then can stretch to fit any size finger.

Figure 11A:
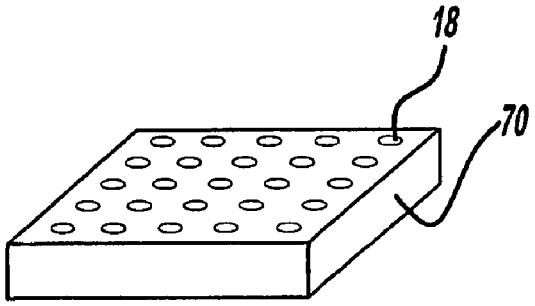
FIG. 11 is a schematic representation of another presently preferred method of making the present applicators.

FIGS. 11*a*–11*e* is a schematic representation of an alternate preferred method of forming the applicators. FIG. 11*a* shows a foam block or sheet 70 having a plurality of finger openings 18 therein. The foam block 70 can be obtained by utilizing any suitable process, such as reaction injection molding or casting the foam material. The finger openings 18 can be formed in the block 70 either during a molding operation or can subsequently be formed in the block 70.

Figure 11B:
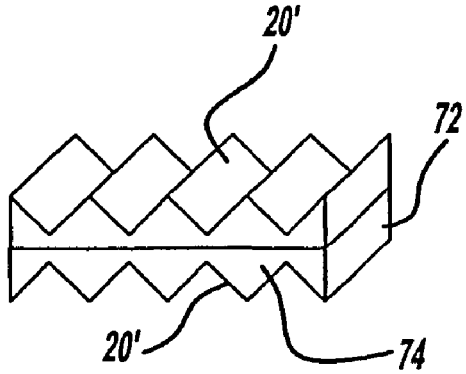

FIG. 11*b* depicts a second block of foam material 72. Preferably, the second block 72 has the tip configurations extending in opposite directions from a central portion 74. The tip configurations 20' can take any shape. It will be appreciated that the second block 72 is formed in any manner, such as for example as that set forth for the first block 70. It will be appreciated that the second block can be formed having the tip configurations extending in only one direction. That is, the second block can be formed to directly provide the sheet as shown in FIG. 11*d*.

Figure 11C:
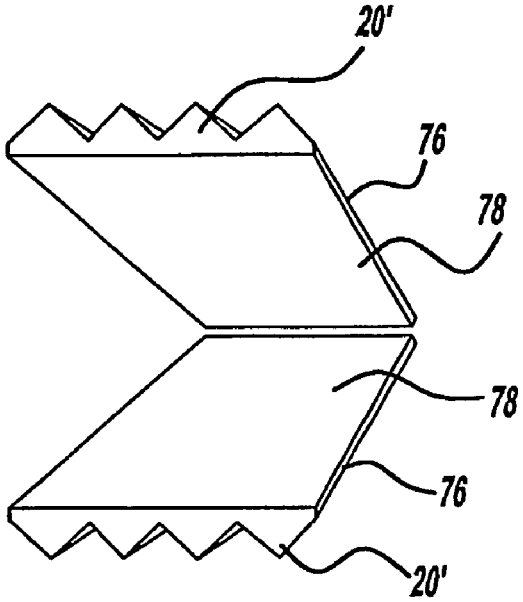
Figure 11D:
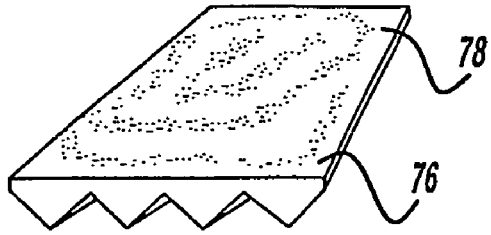
Figure 11E:
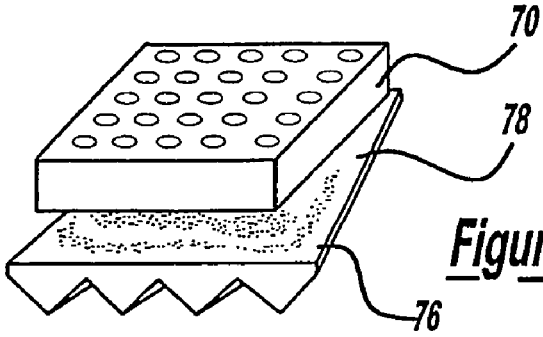

FIG. 11*c* depicts the next step of separating the second block 72 into two separate sheets 76 each having the application tips 20' thereon. Each of the sheets 76 defines a generally flat base surface 78. As shown in FIG. 11*d*, a suitable adhesive may then be applied to the base surface 78. The foam block 70 is then placed on top of the base surface 78 having the adhesive thereon. In this manner, the foam block 70 having one generally flat surface is secured with the sheet 76. Once the adhesive has secured the foam block 70 with the sheet 76, each of the individual applicators 10 may then be cut from the connected separate sheets 76 and foam block 70.

Figure 12A:
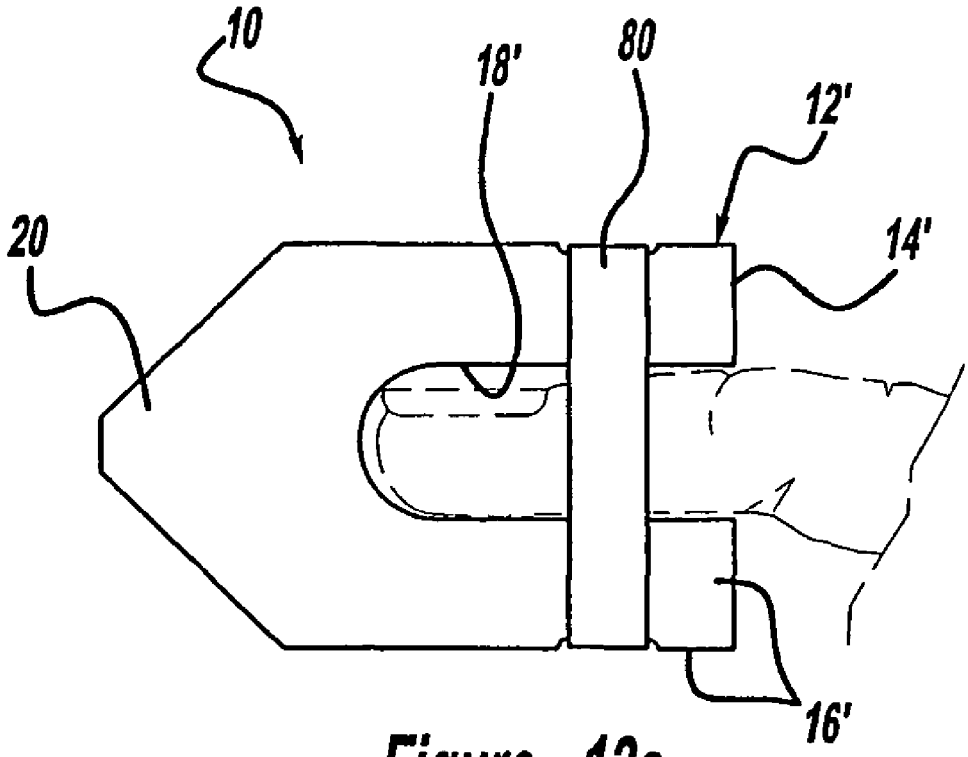
FIG. 12 is an end view of an alternate embodiment of an applicator showing the use of a band to secure the applicator on the user's finger.
Figure 12B:
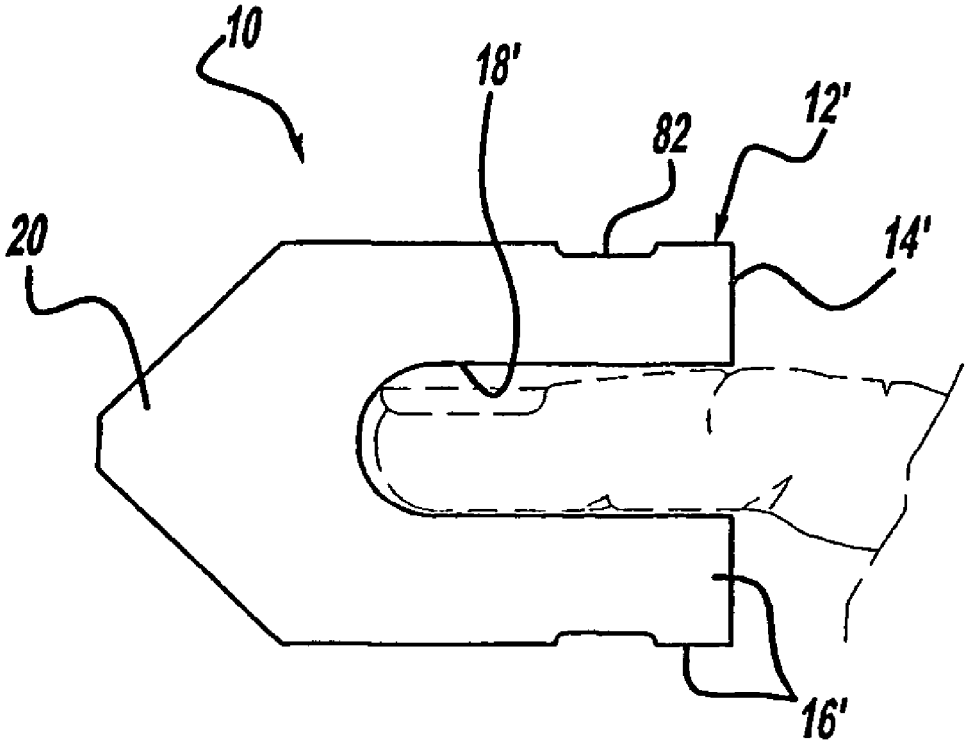
Figure 13A:
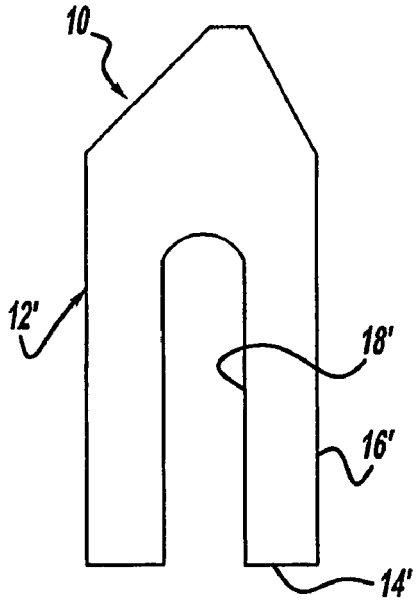
FIG. 13 shows another alternative embodiment of an applicator showing a hook and loop fastener to support the applicator on a user's finger.
Figure 13B:
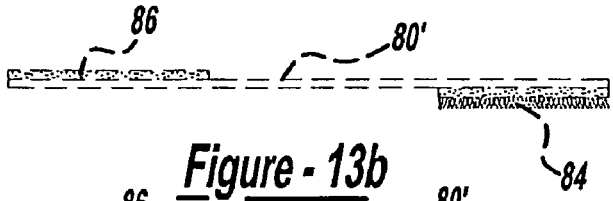
Figure 13C:
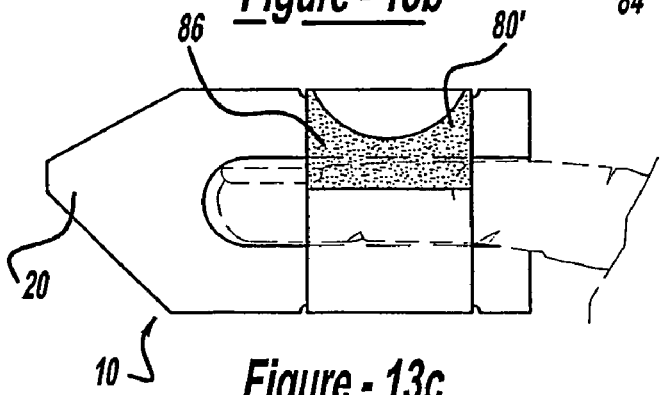
Figure 13D:
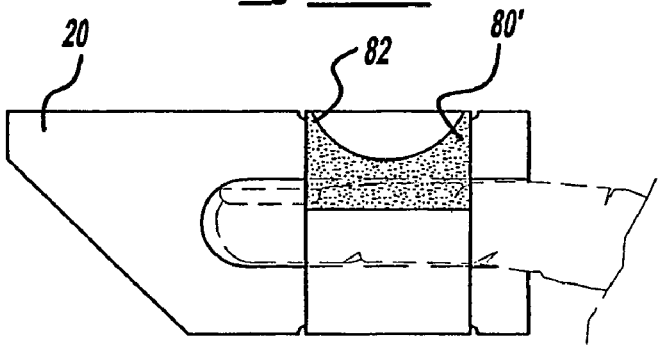
Figure 13E:
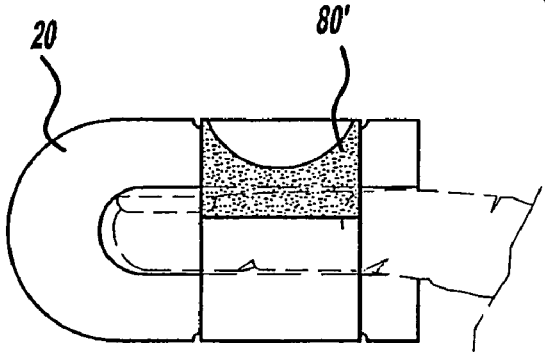
Figure 13F:
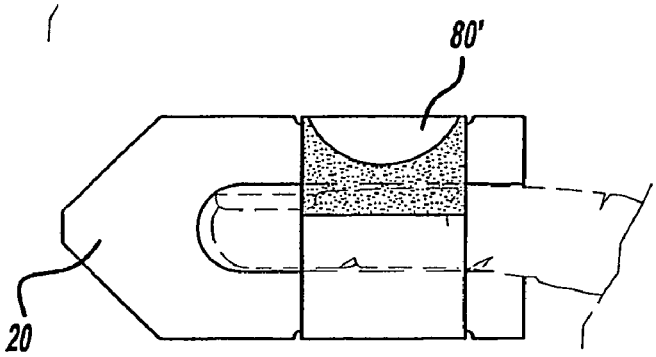

FIGS. 12*a* and 12*b* depict another preferred embodiment of an applicator 10. As shown, the applicator 10 comprises a base block 12' having a bottom surface 14' and side walls 16'. A finger opening 18' is also included. A foam application tip 20 extends from the base block 12'. As shown, the tip 20 is integral with the base block 12'. It will be appreciated, however, that the base block 12' and tip 20 may comprise separate components connected together in a manner set forth above. As shown in FIGS. 12*a* and 12*b*, the finger opening 18' extends through two of the side walls 16', thus creating a slot therebetween. A band 80, such as a band of elastic material, may be placed about the exterior of the side walls 16' to help secure the base block 12' on a user's finger. This is best seen in FIG. 12*a*. Further, the side walls 16' may include a depression 82, best seen in FIG. 12*b*, for receiving the band 80.

It will be appreciated that while the finger opening 18' is shown to extend through two side walls 16' of the base 12', the finger opening 18' may comprise merely an opening between the side walls 16' as is set forth with the embodiments above. Of course it will be appreciated that the application tip 20 may take any configuration, depending on the desired application.

FIGS. 13*a* and 13*c*–13*f* further depict the alternate preferred embodiment of FIGS. 12*a* and 12*b*, but show a different type of band 80'. As shown, the band 80' preferably comprises a hook and loop type strap, commonly known as Velcro. The Velcro strip 80' includes a hook portion 84 and a loop portion 86. The band 80' is wrapped around the base block 12' and secured in the usual manner. Other than with respect to the use of a hook and loop band 80', the configuration of the applicator 10 shown in FIGS. 13*a*–13*f* is the same as that described with respect to FIGS. 12*a* and 12*b*. FIGS. 13*a*, 13*d*, 13*e*, and 13*f* also show various shapes for the application tip 20.

Figure 14:
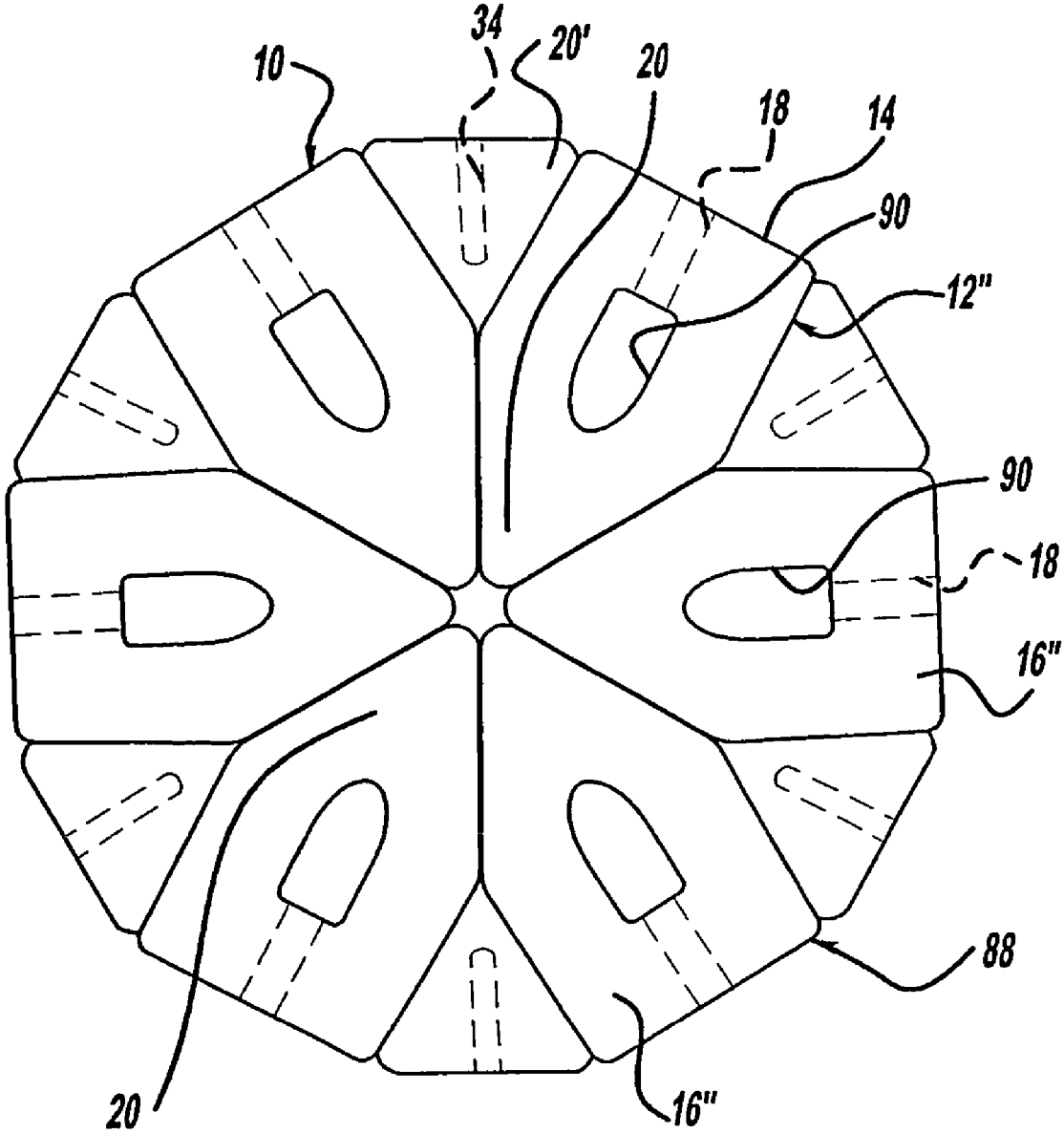
FIG. 14 is a top plan view of a blank for producing various applicator tips.

FIG. 14 is a top plan view of an alternate blank 88 used to make a plurality of applicators 10. The blank 88 may formed from a sheet in the manner as set forth above in connection with the blank 22. Again, it will be appreciated that the blank 88 may comprise a large sheet or rolled good, as set forth above. The blank 88 as shown in FIG. 14 further shows the lines for a plurality of cutting operations. Specifically, once the blank 88 is formed, a plurality of openings, preferably through holes 90 are cut through side walls 16" to form the through hole 90 through the entirety of the block 88. It will be appreciated that while the through hole 90 preferably passes through opposite side walls 16, the through hole may pass only through one side wall 16". In one preferred method, at the same time the through holes 90 are cut into the blank 88, the configuration of the individual applicators, including the application tips 20, is simultaneously cut. In the most preferred embodiment, the individual applicators are cut such that they remain connected by a perforation segment along the lines of the adjacent applicators. Thus, the blank 88 remains integral but each of the individual applicators can be separated from each other any waste material simply by tearing across the remaining perforations.

After the through hole 90 and the cutting of the applicators have been completed, the blank 88 can have the finger openings 18 cut therein. By making the through holes 90, the finger openings 18 can be readily cut from the bottom surface 14 through the interior of the side walls 16" and to the through hole 90. More specifically, the blank 88 with the through holes 90 can have a pin or other support structure (not shown) inserted into the through hole 90 to provide a support for cutting the finger opening 18. This method eliminates the need to simultaneously mold in the finger openings 18 and rather allows the finger openings to be cut into the base block 12".

Once each of these operations have been completed, the individual applicators 10 may be separated from each other and any waste material simply by pulling on the applicator and separating it along the perforation lines that have been cut. In addition to providing a plurality of applicators 10, the block may simultaneously produce a plurality of tips 20' for use in a two-part system may also be included. As shown, the tips 20' can have the receiving opening 34 molded or otherwise cut therein. It will be appreciated that the area between adjacent applicators may comprise an alternate tip 20' or may simply be scrap, discarded material.

Figure 16:
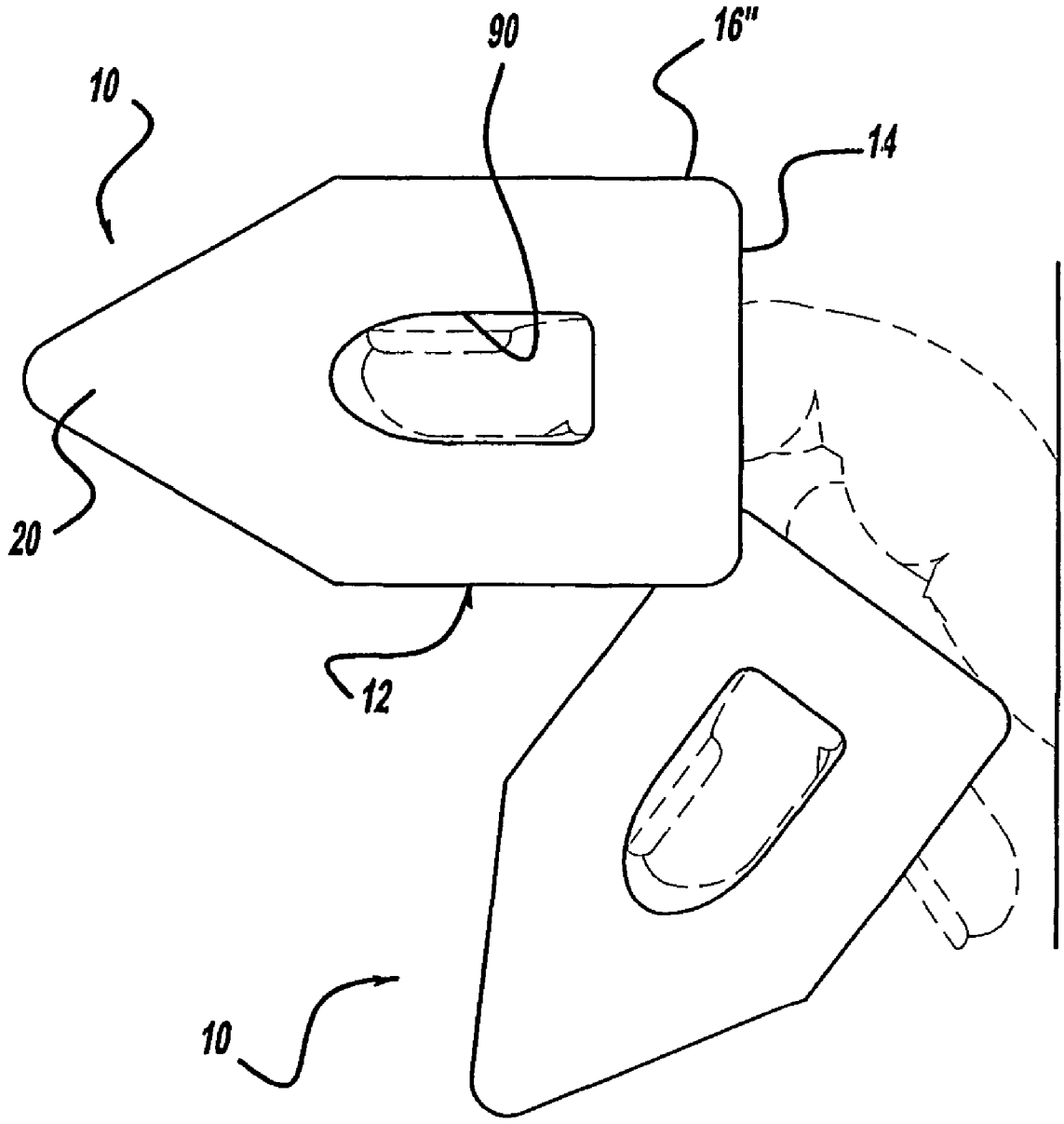
FIG. 16 is a side view of a pair of applicators on a user's finger.

FIG. 16 shows the individual applicator 10 made from the foam blank 88 shown in FIG. 14 in use. The individual applicator 10 is identical to that depicted above with respect to FIGS. 1, 6*f*, and 7*c*, except that the through hole 90 passes through two side walls 16". It will further be appreciated that a band 80' may be placed about the exterior of the side walls 16" to help secure the applicator 10 to the user's finger.

Figure 15:
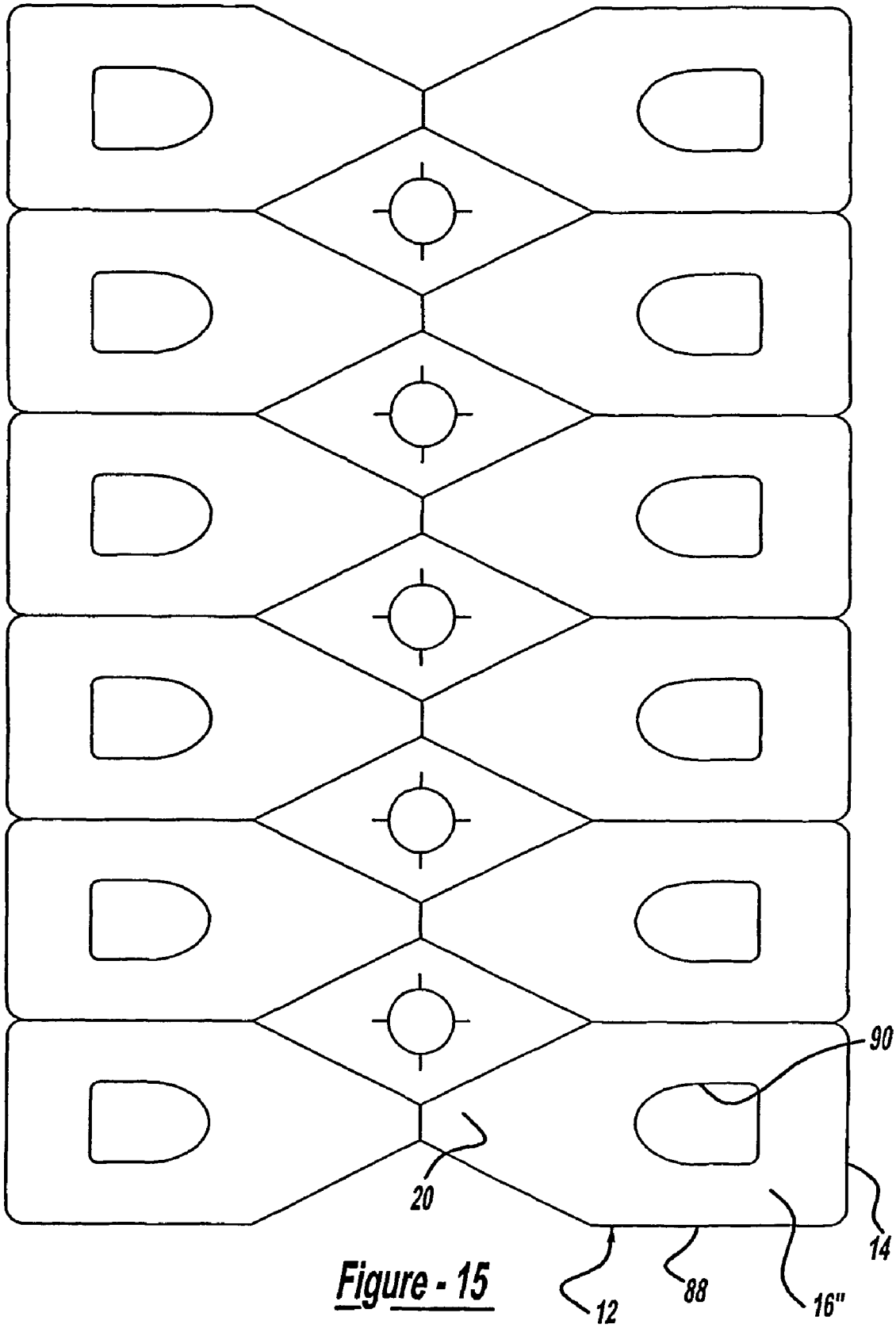
FIG. 15 is a top plan view of an alternate blank design showing a blank for producing various applicators.

FIG. 15 depicts an alternate blank 88' that can be used to make the individual applicators 10 as shown in FIG. 16. The blank 88' has a different exterior configuration than the blank 88 shown in the FIG. 14. Otherwise, the manner of manufacturing the applicators 10 is the same as that described above.

While the finger holes are shown to be formed either by integrally molding them or die cutting them, the holes can be formed in any manner. In addition to molding or die cutting the holes, the holes may be ground into the applicator 10, punched, hot-wire cut, or thermoforming. It will be appreciated that the finger holes can me formed in any manner, including any of the aforesaid methods of forming the finger holes. Similarly, any of the forming operations described above to form the applicators 10 may also utilize any conventional method, such as die cutting, drilling, grinding, molding, punching or hot-wire cutting.

The invention has been described in an illustrative manner as to be understood that the terminology which has been used is intended to be in the nature of words of description rather than of limitation. The disclosed embodiments are representative of presently preferred forms of the invention, but are not intended to be limiting. The invention is defined in the claims.

What is claimed is:

1. A method of forming foam applicators comprising:
forming a foam sheet to define a blank line;
forming the shape of at least one applicator comprising a base block and an application tip in the blank;
forming at least one opening through said base block; and
forming a finger opening in said base block transverse to the opening.

2. A method as set forth in claim 1 further comprising forming the finger opening to connect with the opening.

3. A method as set forth in claim 2 further comprising cutting the shape of the applicators by die cutting the shape such that adjacent of said applicators remain attached by a relatively small amount of foam material.

4. A method as set forth in claim 3 further comprising separating adjacent applicators by applying a manual force.

5. A method as set forth in claim 2 further comprising cutting the shape of the applicators by die cutting the shape to produce a plurality of individual applicators.

6. A method of forming foam applicators comprising:
providing a mold defining a cavity therein;
providing a plurality of finger pins in said cavity;
injecting a foam into the cavity and about said finger pins and reaction injection molding the foam material to define a blank having a plurality of finger openings;
removing the finger pins from the cavity;
removing the blank from the mold;
cutting the shape of at least one applicator comprising a base block and an application tip in the blank, about the finger openings.

7. A method as set forth in claim 6 further comprising coating the finger pins with a non-stick material.

8. A method of forming foam applicators comprising:
forming a first sheet;
forming a plurality of finger openings in said first sheet;
forming a second foam sheet having a plurality of application tips formed thereon;
adhering the first sheet with the second foam sheet;
forming the applicators from the combined first sheet and second foam sheet such that each applicator defines a base block with the finger opening and an application tip extending from the base block.

9. A method as set forth in claim 8 wherein the first sheet is foam.

10. A method as set forth in claim 8 wherein the second foam sheet is made by forming a foam block having application tips extending from two sides, and separating the foam block into two second foam sheets each including a plurality of application tips.

11. A method as set forth in claim 8 wherein said first and said second sheets each include a generally flat surface.

12. A method of forming foam applicators comprising:
providing an applicator having an application tip and a base block wherein each of the application tip and the base block comprise foam;
positioning a forming tool in the base block; and
applying pressure and heat to the base block to define a base block having a finger opening for receiving a user's finger.

13. A method of forming foam applicators comprising:
forming a first sheet of foam material to define a blank;
forming at least one applicator from the blank such that each applicator defines a base block and an application tip extending from the base block; and
molding a finger opening in the base block for receiving a user's finger.

14. A method as set forth in claim 13 further comprising forming an opening in said base block transverse to the finger opening.

15. A method as set forth in claim 14 further comprising forming the finger opening to connect with the opening.

16. A method as set forth in claim 13 further comprising cutting the shape of the applicators by die cutting the shape such that adjacent of said applicators remain attached by a relatively small amount of foam material.

17. A method as set forth in claim 16 further comprising separating adjacent applicators by applying a manual force.

18. A method as set forth in claim 13 further comprising cutting the shape of the applicators by die cutting the shape to produce a plurality of individual applicators.

19. A method as set forth in claim 13 wherein said sheet is formed by casting foam material.

20. A method as set forth in claim 19 wherein each applicator is formed by die cutting the applicator.

21. A method as set forth in claim 13 wherein said sheet is formed by reaction injection molding foam material.

22. A method as set forth in claim 21 wherein each applicator is formed by die cutting the applicator.

23. A method as set forth in claim 13 wherein the base block includes at least a pair of side walls, and forming the finger opening through the side walls to thereby create a slot therebetween.

24. A method as set forth in claim 23 further comprising placing a band about the exterior of the side wall to secure the base block on a user's finger.

25. A method as set forth in claim 24 wherein the band is elastic.

26. A method as set forth in claim 25 wherein the band comprises a hook and loop strap.

27. A method of forming foam applicators comprising:

forming a first sheet of foam material to define a blank;

forming at least one applicator from the blank such that each applicator defines a base block and an application tip extending from the base block; and die cutting a finger opening in the base block for receiving a user's finger.

* * * * *